US010851493B2

(12) United States Patent
Watanabe et al.

(10) Patent No.: US 10,851,493 B2
(45) Date of Patent: Dec. 1, 2020

(54) RUNNING WIRE ROPE AND METHOD OF MANUFACTURING SAME

(71) Applicant: TOKYO ROPE MANUFACTURING CO., LTD., Tokyo (JP)

(72) Inventors: Shigeki Watanabe, Tokyo (JP); Kaori Kanamori, Tokyo (JP); Jun Takeuchi, Tokyo (JP)

(73) Assignee: TOKYO ROPE MANUFACTURING CO., LTD., Tokyo (JP)

( * ) Notice: Subject to any disclaimer, the term of this patent is extended or adjusted under 35 U.S.C. 154(b) by 47 days.

(21) Appl. No.: 16/295,002

(22) Filed: Mar. 7, 2019

(65) Prior Publication Data

US 2019/0203412 A1 Jul. 4, 2019

Related U.S. Application Data

(63) Continuation of application No. PCT/JP2016/076926, filed on Sep. 13, 2016.

(51) Int. Cl.

*D07B 1/06* (2006.01)
*D07B 1/16* (2006.01)
*D07B 1/00* (2006.01)

(52) U.S. Cl.

CPC ..... *D07B 1/0686* (2013.01); *D07B 1/005* (2013.01); *D07B 1/0693* (2013.01); *D07B 1/16* (2013.01);

(Continued)

(58) Field of Classification Search

CPC .... D07B 1/005; D07B 1/0686; D07B 1/0693; D07B 1/16

See application file for complete search history.

(56) References Cited

U.S. PATENT DOCUMENTS 3,530,661 A * 9/1970 Thomen ..... D07B 5/007 57/6
3,705,489 A * 12/1972 Smollinger ..... D07B 1/0686 57/214

(Continued)

FOREIGN PATENT DOCUMENTS

CH 689098 A5 9/1998
DE 2703670 A1 * 8/1978 ..... D07B 1/0686

(Continued)

OTHER PUBLICATIONS

Machine Translation of DE 2703670 A1, Retrieved Jun. 2020.*

*Primary Examiner* — Shaun R Hurley
(74) *Attorney, Agent, or Firm* — Dickinson Wright PLLC

(57) ABSTRACT

A wire rope formed from a resin core and six strands, the resin core having an inner core with a circular cross section and an outer layer built up on the periphery thereof. The outer layer has a melting temperature lower than that of the inner core. The six strands are twisted together helically on the periphery of the resin core in an intertwining die in such a state that gaps are assured between the strands. The resulting wire rope is heated in a heating unit at a temperature higher than the melting temperature of the outer layer but lower than the melting temperature of the inner core. The wire rope is formed by subsequently compressing the six strands from the periphery thereof in a compressing die. The molten outer layer is hardened by natural cooling, after which the wire rope is taken up.

7 Claims, 3 Drawing Sheets

Figure 1:
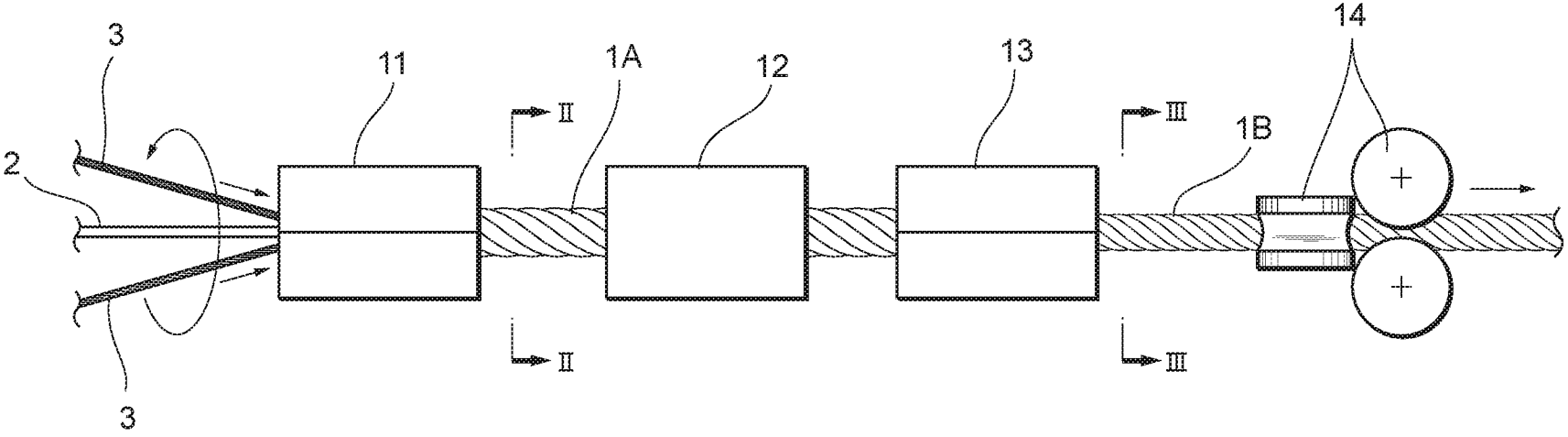

(52) U.S. Cl.
CPC ..... *D07B 2201/108* (2013.01); *D07B 2201/1032* (2013.01); *D07B 2201/2019* (2013.01); *D07B 2201/2065* (2013.01); *D07B 2205/2003* (2013.01)

(56) References Cited

U.S. PATENT DOCUMENTS

| | | | | | |
|---|---|---|---|---|---|
| 3,778,994 | A * | 12/1973 | Humphries | D07B 1/0693 | 57/214 |
| 5,797,254 | A * | 8/1998 | Walton | D07B 1/0686 | 57/220 |
| 6,317,540 | B1 * | 11/2001 | Foulger | H01B 7/32 | 385/100 |
| 6,563,054 | B1 | 5/2003 | Damien et al. | | |
| 8,176,718 | B2 | 5/2012 | Ridge et al. | | |
| 8,943,789 | B2 * | 2/2015 | Takeuchi | D07B 7/027 | 57/220 |
| 9,162,849 | B2 * | 10/2015 | Mitsui | B66B 7/06 | |
| 9,309,620 | B2 * | 4/2016 | Amils | D07B 1/068 | |
| 9,896,307 | B2 * | 2/2018 | Mitsui | B66B 7/06 | |
| 9,902,594 | B2 * | 2/2018 | Mitsui | D07B 1/0673 | |
| 2012/0180926 | A1 * | 7/2012 | Rebouillat | D07B 1/0613 | 152/527 |
| 2013/0318937 | A1 * | 12/2013 | Takeuchi | D07B 5/007 | 57/220 |
| 2018/0251940 | A1 * | 9/2018 | Carter | D07B 7/12 | |
| 2018/0362300 | A1 * | 12/2018 | Mitsui | B66B 7/06 | |

FOREIGN PATENT DOCUMENTS

| | | | | |
|---|---|---|---|---|
| JP | 2015139818 | A | 8/2015 | |
| WO | WO-2012056529 | A1 * | 5/2012 | D07B 1/162 |
| WO | 2014053601 | A1 | 4/2014 | |

* cited by examiner

RUNNING WIRE ROPE AND METHOD OF MANUFACTURING SAME

CROSS-REFERENCE TO RELATED APPLICATIONS

This application is a Continuation Application of PCT Application No. PCT/JP2016/076926, filed Sep. 13, 2016, the entire disclosure of the application being considered part of the disclosure of this application and hereby incorporated by reference.

TECHNICAL FIELD

This invention relates to a running wire rope, namely a wire rope for a running cable used, for example, as the running cable for a gondola, the running cable for an elevator and as the running cable of other facilities or equipment.

BACKGROUND OF THE INVENTION

A running wire rope used as a running cable sustains repeated bending under tension. In a case where a fiber core is used as the core material of a running wire rope, the diameter of the fiber core undergoes a reduction in diameter and so does the diameter of the wire rope itself. When the diameter of the wire rope decreases, the wire rope elongates in the longitudinal direction. If a running wire rope used in a gondola or elevator or the like sustains an excessive amount of elongation in the longitudinal direction, the wire rope must be cut off by the amount of such elongation.

BRIEF DESCRIPTION OF THE INVENTION

An object of the present invention is to markedly suppress contact between strands as well as suppress a decrease in diameter and prevent elongation of a wire rope during use thereof.

A method of manufacturing a running wire rope according to the present invention is characterized by helically twisting together a plurality of strands, in a state in which gaps are assured between the strands, around a resin core in which a resin outer layer has been built up on the periphery of a resin inner core having a circular cross section, the outer layer having a melting temperature lower than that of the inner core; heating at a temperature higher than the melting temperature of the outer layer and lower than the melting temperature of the inner core, thereby melting the outer layer; compressing the plurality of strands from the periphery thereof; and hardening the outer layer.

The resin core is constituted by an inner core, which is made of resin, and an outer layer, which is made of resin, that has been built up on the periphery of the inner core and that has a melting temperature lower than that of the inner core. Therefore, when heat is applied at a temperature higher than the melting temperature of the outer layer and lower than the melting temperature of the inner core, only the outer layer melts without causing the melting of the inner core. A plurality of strands are twisted together helically in a state in which gaps are assured between the strands. When the plurality of strands are compressed from the periphery thereof with the outer layer in the molten state, the molten outer layer flows diametrically outward and penetrates into the gaps between the plurality of strands being compressed inward. The molten outer layer penetrates also into valleys between wires on the surface of strands that face the gaps.

Thereafter the molten outer layer is hardened by passage through a cooling step (natural or forced cooling). The resin of the outer layer hardens while maintaining a shape that conforms to the shape of the gaps between the strands following the compression thereof and the shape of the valleys between wires on the surface of strands that face the gaps.

In accordance with the present invention, the gaps between the plurality of strands and the valleys between wires on the surface of strands that face the gaps are filled by the resin of the fluidic or molten outer layer. As a result, mutually adjacent strands will not come into direct contact and fretting wear can be prevented. Further, it is possible to reduce deformation of the wire rope when the wire rope is bent by being engaged with a sheave. Furthermore, since the inner core is not melted by heating, a wire rope is provided in which the plurality of strands compressed from the periphery thereof are supported by the inner core so that there will be no reduction in diameter even with continuous use and, hence, little or almost no elongation.

In an embodiment, the plurality of strands are compressed to such a degree that the strands bite into the inner core. Preferably, the plurality of strands are compressed and caused to bite into the surface of the inner core to a depth of not more than 10% of the outer diameter of the inner core. By compressing the plurality of strands comparatively strongly, elongation of the wire rope can be markedly suppressed. By stopping the strands from biting in to a depth of not more than 10% with respect to the outer diameter of the inner core, the occurrence of a large amount of elongation owing to a decline in the strength of the core can be prevented.

A running wire rope according to the present invention comprises: a resin core in which a resin outer layer has been built up on the periphery of a resin inner core having a circular cross section, the outer layer having a melting temperature lower than that of the inner core; and a plurality of strands twisted together helically on the periphery of the resin core; wherein the plurality of strands are in contact with the inner core or bite into the inner core, and the gaps between the plurality of strands as well as the valleys between wires on the surface of strands that face the gaps are filled by hardened resin constituting the outer layer, which has a shape conforming to the shape of the gaps and the shape of the valleys. According to the present invention, there is provided a wire rope in which fretting wear will not readily occur, in which there is little deformation when the wire rope is bent by being engaged with a sheave, and in which there will be no reduction in diameter even with continuous use and, hence, little or almost no elongation.

In one embodiment, a difference in melting temperature between the inner core and the outer layer is equal to or greater than 15° C., to allow only the outer layer to melt assuredly without causing melting of the inner core.

In an embodiment, the melting temperature of the outer layer is equal to or greater than 80° C., to allow melting or softening of the outer layer to be suppressed during use or transport of the wire rope.

In another embodiment, the outer layer has a melt flow rate of not more than 30 g/10 min, to allow dripping of the outer layer when the outer layer is heated and melted to be prevented.

BRIEF DESCRIPTION OP THE DRAWINGS

Figure 2:
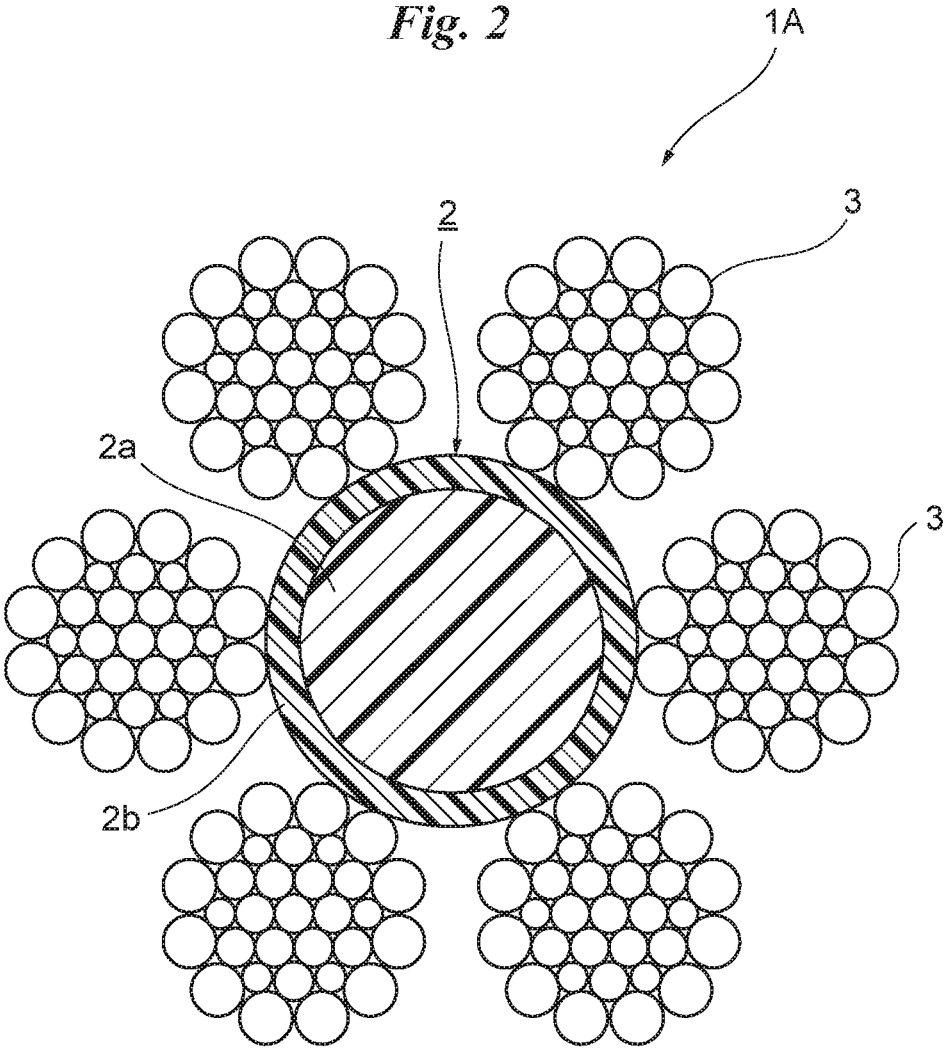
Figure 3:
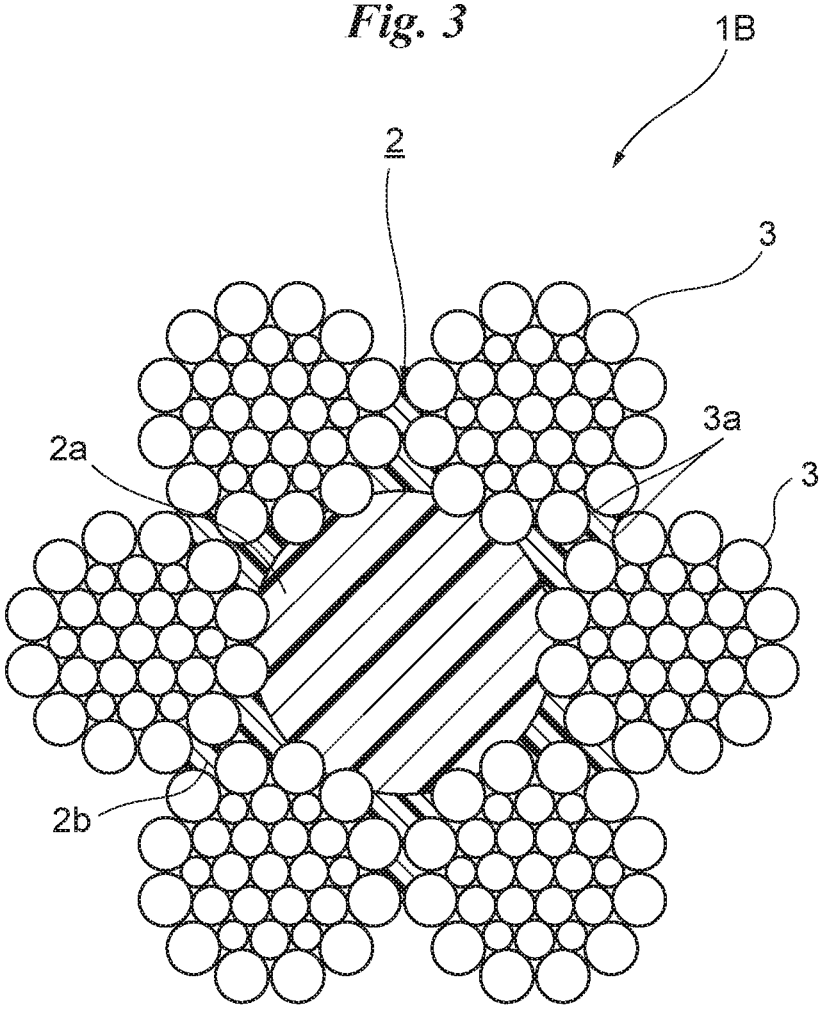

FIG. 1 diagrammatically illustrates a wire rope manufacturing apparatus;

FIG. 2 is a cross-sectional view of a wire rope in the course of manufacture; and FIG. 3 is a cross-sectional view of a completed wire rope.

DETAILED DESCRIPTION OF THE INVENTION

FIG. 1 diagrammatically illustrates a wire rope manufacturing apparatus with the wire rope being formed and FIGS. 2 and 3 are cross-sectional views of a wire rope taken along lines II-II and of FIG. 1, respectively.

With reference to FIG. 1, a single resin core 2 and six strands 3 sent from a wire stranding machine (not shown) are fed to an intertwining die 11.

With reference to FIG. 2, the resin core 2 is composed of a high-density polyethylene inner core 2*a* having a circular cross section, and a low-density polyethylene outer layer 2*b*, which has an annular cross section, obtained by being built up on (applied as a coating to) the outer peripheral surface of the core 2*a* to a uniform thickness. The core 2*a* is fabricated in a solid state as by extrusion molding or pultrusion molding. The outer layer 2*b* is built up on (applied as a coating to) the outer peripheral surface of the core 2*a* to a uniform thickness as by extrusion lamination.

The melting point (melting temperature) of the high-density polyethylene constituting the inner core 2*a* is on the order of 120 to 140° C., and the melting point of the low-density polyethylene constituting the outer layer 2*b* is on the order of 95 to 115° C. Thus the melting point of the outer layer 2*b* is lower than that of the inner core 2*a*. Resins of other types having a difference in melting point may be selected as the inner core 2*a* and outer layer 2*b*, respectively. Preferably, two types of thermoplastic resin having a difference in melting point equal to or greater than 15° C. are selected as the respective resins constituting the inner core 2*a* and outer layer 2*b*. Further, in order to suppress melting or softening of the outer layer 2*b* during use or transport of the wire rope, a resin having a melting point equal to or greater than 80° C. preferably is selected as the outer layer 2*b*. A polyolefin resin imparted with flexibility and weather resistance is suitable as the resin constituting the inner core 2*a* and outer layer 2*b*.

Furthermore, the outer layer 2*b* is adjusted in such a manner that the melt flow rate, which is measured according to ISO 1133 (JIS K 7210), will be not more than 30 g/10 min, preferably not more than 20 g/10 min. For example, the melt flow rate of the outer layer 2*b* can be adjusted by changing the molecular weight of the resin or by mixing in an additive, such a filler, that adjusts the melt viscosity.

Each strand 3 in this embodiment is obtained by twisting together a total of 31 steel wires in Warrington-Seale form. The number of steel wires that constitute the strand 3, the structure of the twisted wires and the number of strands 3 that constitute the wire rope can be modified appropriately in accordance with such factors as the tensile strength sought for the wire rope.

With reference to FIG. 1, the resin core 2 and the six strands 3 are gathered together and the six strands 3 are twisted helically around the resin core 2 in the intertwining die 11.

A jig may be placed at the entrance to the intertwining die 11 for the purpose of arranging the six strands 3 in helical form around the resin core 2 while assuring gaps at equal intervals. With reference to FIG. 2, a wire rope 1A which has passed through the intertwining die 11 takes on a state in which the six strands 3 have been twisted into helical form with gaps assured between mutually adjacent strands 3 around the resin core 2.

The wire rope 1A next proceeds to a heating unit 12.

The heating unit 12 used is, for example, one having a coil in which temperature is capable of being controlled by induction heating. When passing through the coil possessed by the heating unit 12, the wire rope 1A (strands 3) is heated uniformly from the periphery thereof.

The heat applied by the heating unit 12 is performed at a temperature higher than the above-mentioned melting point of the outer layer 2*b* but lower than the melting point of the inner core 2*a*. As a result, only the outer layer 2*b* is caused to melt; the inner core 2*a* can remain solid as is due to the fact that the inner core 2*a* and outer layer 2*b* have melting points that differ by 15° C. or more, causing only the outer layer 2*b* to melt and not the inner core 2*a* is facilitated. The molten outer layer 2*b* tends to drip downward. As mentioned above, however, since the melt flow rate of the outer layer 2*b* is adjusted to not more than 30 g/10 min, preferably not more than 20 g/10 min, the molten outer layer 2*b* can be prevented from dripping. Even after the heating process, a state can be maintained in which the outer layer 2*b* is built up on the periphery of the inner core 2*a* to a uniform thickness.

The wire rope 1A with the molten outer layer 2*b* next proceeds to a compressing die 13 where the six strands 3 are strongly compressed from the periphery. Preferably, a perfectly circular die having a bore with a perfectly circular cross section is used as the compressing die 13.

With reference to FIG. 3, owing to the fact that the six strands 3 are strongly compressed from the periphery thereof in the compressing die 13, the six strands 3 all move toward the center of the wire rope so as to narrow the gaps between the strands 3. Preferably, the six strands 3 are compressed by the compressing die 13 under a force that will produce slight depressions in the inner core 2*a* situated at the center of the resin core 2, e.g., a force that will cause the strands to bite in to a depth of not more than 10% with respect to the outer diameter of the inner core 2*a*. The diameter of wire rope 1B, which is the final product, is determined in the compressing die 13.

Since the outer layer 2*b* on the periphery of the inner core 2*a* is molten, when the six strands 3 are compressed by the compressing die 13, the outer layer 2*b* flows diametrically outward and flows into the helical gaps between mutually adjacent strands 3. Further, the molten outer layer 2*b* fills also valleys (helical grooves) 3*a* between wires on the surface of strands 3 that face the gaps between the strands 3. The wire rope 1B fed out from the compressing die 13 is such that the diameter thereof is smaller than that of the above-mentioned wire rope 1A.

The wire rope 1B is subsequently fed to straightening rolls 14 where the curvature and flatness of the wire rope 1B are corrected.

The molten outer layer 2*b* of the wire rope 1B is hardened by natural cooling up until the wire rope reaches a take-up step. It is of course permissible to forcibly cool the outer layer 2*b*, such as by air cooling. After the outer layer 2*b* hardens, the wire rope 1B is taken up on a take-up bobbin (not shown).

Since the six strands 3 are supported from the center by the inner core 2*a*, the diameter thereof undergoes almost no reduction even after continuous use and, as a result, there is very little elongation of the wire rope 1B. Further, the outer layer 2*b* (the resin constituting the outer layer 2*b*), penetrates, in the molten state, into the gaps between the six strands 3 and into the valleys 3*a* between wires on the surface of the strands 3, after which the outer layer 2*b* hardens so as to be held in place. Fretting wear, which is caused by the strands 3 rubbing against each other, is prevented or reduced, and it is possible to also reduce deformation of the wire rope 1B when the wire rope 1B is bent by being engaged with a sheave.

What is claimed is:

1. A method of manufacturing a running wire rope, comprising:

helically twisting together a plurality of strands, in a state in which gaps are assured between the strands, around a resin core in which a resin outer layer has been built up on the periphery of a resin inner core having a circular cross section, said outer layer having a melting temperature lower than that of said inner core;

heating at a temperature higher than the melting temperature of the outer layer and lower than the melting temperature of the inner core, thereby melting the outer layer;

compressing the plurality of strands from the periphery thereof; and hardening the outer layer.

2. A method of manufacturing a running wire rope according to claim 1, including compressing the plurality of strands to thereby cause the strands to bite into the surface of the inner core to a depth of not more than 10% of the outer diameter of the inner core.

3. A method of manufacturing a running wire rope according to claim 1, including hardening the outer layer by natural cooling or forced cooling.

4. A running wire rope having a center, the running wire rope comprising:

a resin core, provided at the center of the running wire rope, wherein said resin core includes a resin inner core having a circular cross section and a resin outer layer built up on the periphery of a resin inner core, said outer layer having a melting temperature lower than that of said inner core; and a plurality of strands twisted together helically on the periphery of said resin core;

wherein said plurality of strands are in contact with said inner core or bite into said inner core, and gaps between said plurality of strands as well as valleys between wires on the surface of the strands that face the gaps are filled by hardened resin constituting said outer layer, which has a shape conforming to the shape of the gaps and the shape of the valleys.

5. The running wire rope according to claim 4, wherein a difference in melting temperature between said inner core and said outer layer is equal to or greater than 15° C.

6. The running wire rope according to claim 4, wherein the melting temperature of said outer layer is equal to or greater than 80° C.

7. The running wire rope according to claim 4, wherein said outer layer has a melt flow rate of not more than 30 g/10 min.

* * * * *